United States Patent [19]

Norris et al.

[11] 4,170,103

[45] Oct. 9, 1979

[54] NODE FIXATION IN SELF-TWIST YARN

[75] Inventors: Alan H. Norris; Phillip W. Chambley, both of Rome, Ga.

[73] Assignee: WWG Industries, Inc., Rome, Ga.

[21] Appl. No.: 891,068

[22] Filed: Mar. 29, 1978

[51] Int. Cl.[2] ..... H01B 13/04; D02G 3/26

[52] U.S. Cl. ..... 57/293; 57/22

[58] Field of Search ..... 57/34 AT, 22, 157 F, 57/293, 350

[56] References Cited

U.S. PATENT DOCUMENTS

| | | | |
|---|---|---|---|
| 3,407,583 | 10/1968 | Irwin et al. | 57/22 |
| 3,434,275 | 3/1969 | Bacher et al. | 57/34 AT X |
| 3,572,025 | 3/1971 | Irwin | 57/22 |
| 3,775,955 | 12/1973 | Shah | 57/34 AT |
| 4,002,012 | 1/1977 | Norris et al. | 57/22 |

*Primary Examiner*—Charles Gorenstein

*Attorney, Agent, or Firm*—Beveridge, DeGrandi, Kline & Lunsford

[57] ABSTRACT

False-twisted yarns are continuously fed to a locking mechanism on a rotating guide wheel. The locking device has a clamping shoe for engaging the yarn, after which the direction of false twist is reversed. Two additional clamping shoes then engage the yarn upstream and downstream of the first clamping point. The first shoe is then retracted to permit the twist between the additional shoes to cancel, and a fluid vortex is used to entangle the yarn filaments, locking the node.

7 Claims, 10 Drawing Figures

NODE FIXATION IN SELF-TWIST YARN

This invention relates to a method and apparatus for joining yarn strands in a continuous yarn production system.

BACKGROUND OF THE INVENTION

In our U.S. Pat. No. 4,002,012 issued Jan. 11, 1977, there is shown a splicing apparatus which operates to join the ends of yarns using a circumferential air jet to spin the yarns. By this spinning procedure, the fibers of the yarns are moved rapidly and the heat generated by fiber friction operates, with thermoplastic yarns, to bond adjacent fibers.

It has been found that the splicer shown in that patent operates to join either staple or continuous filament yarns. However, it has also been found that it is too slow in operation to be used as part of a high speed continuous self-twist yarn making system because its operation is based on work heating of the fibers. Consider, for example, a system in which false-twist, self-twist yarns are to be produced at a rate of 100 yards per minute with two twist reversals per yard and wherein the nodes (the locations of twist reversal) of adjacent strands are to be joined to each other before self-twisting. It will be apparent that the fixation or joining device will need to operate 200 times per minute. In practice, somewhat less than 1/200 of a minute (5 milliseconds) is available for each joining, and it is therefore necessary to have a joining device which will accomplish its task in order that the joining step itself not be a factor limiting the speed of the entire production system.

It will also be recognized that joining devices as employed in previous systems rely upon pushing filaments from one yarn strand into between and among filaments of a second strand, and that this is only possible if the two bundles of filaments which comprise the strands are loosely packed and can easily be separated from each other. This condition is not present if either one of the strands contains any twist since the twist constricts each bundle of filaments into a relatively coherent strand. It will also be noted that a similar tightly constricted condition exists if the tension in the strands is too high.

BRIEF DESCRIPTION OF THE INVENTION

In accordance with the present invention, there is provided an apparatus usable in a continuous yarn production system wherein the yarns are twisted and then a portion is engaged at spaced points, permitting the twist between those points to be removed. This results in a relatively short portion of the strands having substantially no twist and decreased tension. That portion is then subjected to a fluid vortex which twists the strands together and joins them in the engaged portion. The engaging means is movable with the yarn along a guide path so that, during the time of engagement, the joining takes place, the result being viewable as a "flying joiner."

Briefly described, the invention includes a method of joining yarn strands at longitudinally spaced points in a continuous yarn production system of the type having means for forming and longitudinally moving a plurality of yarn strands, and reversible twisting means for imparting false twist to each of the longitudinally moving strands in alternating length segments of S and Z twist, the method including the steps of engaging the yarn strands at a first point downstream of the twisting means to establish a twist trap point, reversing the twist direction of said twisting means, engaging the yarn strands at second and third points spaced upstream and downstream, respectively, of said first point and downstream of said twisting means, the spacings between the first point and the second and third points being chosen to include substantially equal numbers of turns of opposite twist between said first point and said second and third points, releasing the strands at said first point to permit the strands bwetween said second and third points to untwist, joining the strands together between said second and third points to form joined nodes of twist reversal, and releasing the strands at the second and third points and permitting the strands to self-twist.

The invention further includes an apparatus for repetitively joining yarn strands at longitudinally spaced points in a continuous yarn production system of the type having means for forming and longitudinally moving a plurality of yarn strands and reversible twisting means for imparting false twist to each of the longitudinally moving strands in alternating length segments of S and Z twist, comprising the combination of first means downstream of the twisting means for gripping the yarn strands at a first point at which the twist in said strands reverses, second means for gripping the strands at second and third points on opposite sides of said first point relative to the direction of motion of the strands, said first and second means being longitudinally movable with the strands, control means for actuating said first and second gripping means in sequence and for causing said first means to be released after actuation of said second means, and fluid jet means for directing a jet of fluid under pressure at said strands between said second and third points to entangle the fibers of said strands and thereby join the strands together.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF THE INVENTION

Figure 1:
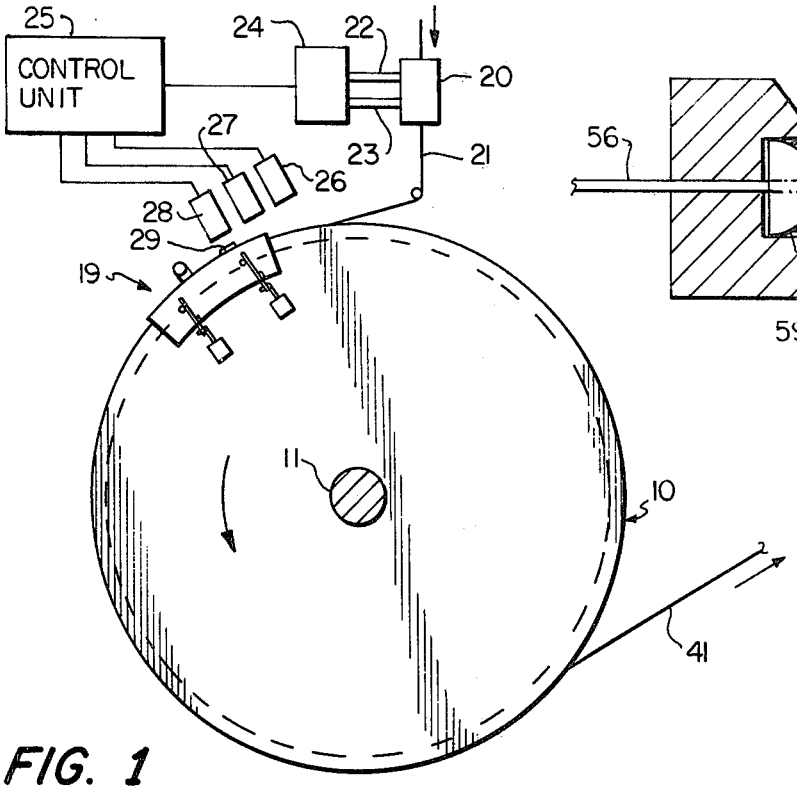
FIG. 1 is a schematic side elevation of an apparatus incorporating the present invention.
Figure 9:
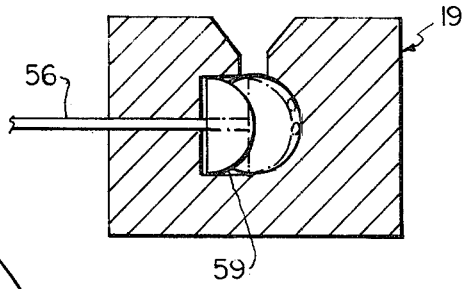
FIG. 9 is an enlarged sectional view along line 9—9 of FIG. 7.
Figure 2:
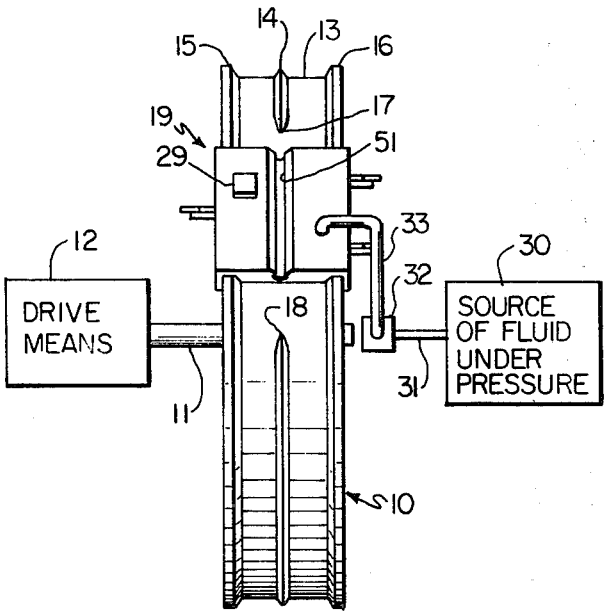
FIG. 2 is a front elevation of a portion of the apparatus of FIG. 1.
Figure 10:
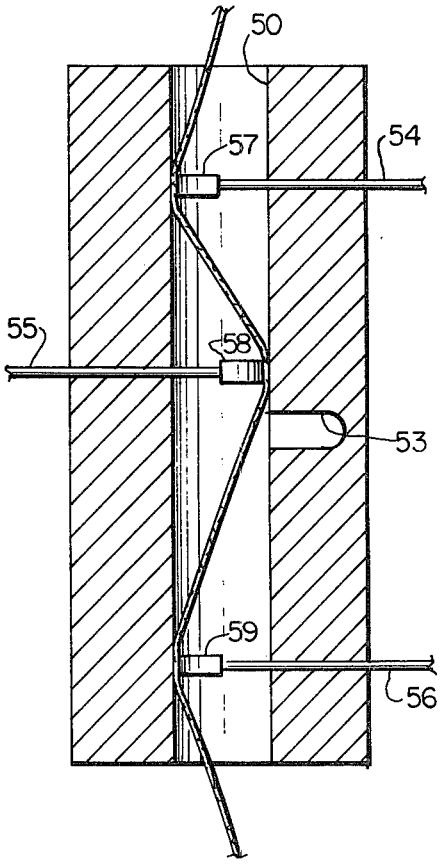
FIG. 10 is a partial sectional view along line 10—10 of FIG. 7.

Referring first to FIGS. 1 and 2, it will be seen that the apparatus includes a yarn guide wheel 10 which is mounted on a rotatable shaft 11 which is coupled to and driven by a drive means 12 such as a conventional electric motor. The guide wheel has a peripheral guide surface 13 divided into two portions by a separatory flange 14 and defined by outer flanges 15 and 16. Flange 14 divides the path into two portions so that the yarns are maintained in separated condition except for that portion between the ends 17 and 18 of the separatory flange wherein there is a joining apparatus indicated generally at 19. Yarn strands are supplied to the guide wheel from a pair of twisting jets 20, only one of which is visible in FIG. 1. Jets 20 can be of the type shown and described in U.S. patent application Ser. No. 755,671, filed Dec. 30, 1976, now U.S. Pat. No. 4,074,511 and assigned to the assignee of the present application. As seen in FIGS. 9–11 of that application, the twisting jets each include a central passage through which a yarn strand 21 can pass and a pair of conduits intersecting that passage offset from the centerline thereof so that when fluid under pressure, such as air, is supplied to one of the conduit, the yarn passing through the central passage is twisted in one direction, but if the fluid under pressure is supplied to the other conduit, the yarn is twisted in the opposite direction. These conduits are represented in FIG. 1 as conduits 22 and 23 and receive air under pressure from a pressure source 24 having valve means for selectively supplying the air to one of the conduits. A control unit 25 can be provided to control the valving action to reverse the direction of twist in synchronism with the rotation of wheel 10.

In order to sense the rotational position of wheel 10, sensing means can be provided adjacent the wheel, this being illustrated by photoelectric sensors 26, 27 and 28 located adjacent the periphery of the wheel. A highly reflective surface portion 29 is provided on the joining device 19 so that light emanating from within each of the sensors is reflected back to a photocell within the sensor as surface portion 29 passes each of the sensors. Electrical signals produced by reception of the reflected light is provided to the control unit to signal the time for switching the direction of rotation.

Additionally, the control unit can supply electrical signals to the joining apparatus on the wheel itself, as through slip rings carried by shaft 11. These signals will control the operation of the joining apparatus itself, to be further described. Alternatively, separate sensing means can be employed, but it should be noted that synchronization between the direction of twist and the operation of the joining device is important. It will also be recognized that the sensors can be magnetic devices or other switching means, the specific nature of the sensing being of minimal consequence.

As seen in FIG. 2, a source of fluid under pressure 30 supplies fluid, such as air, through a conduit 31, a rotatable fluid coupling joint 32, and a rotating conduit portion 33 to joining means 19 for accomplishing the joining function. Source 30 can also be under the control of unit 25.

Figure 3:
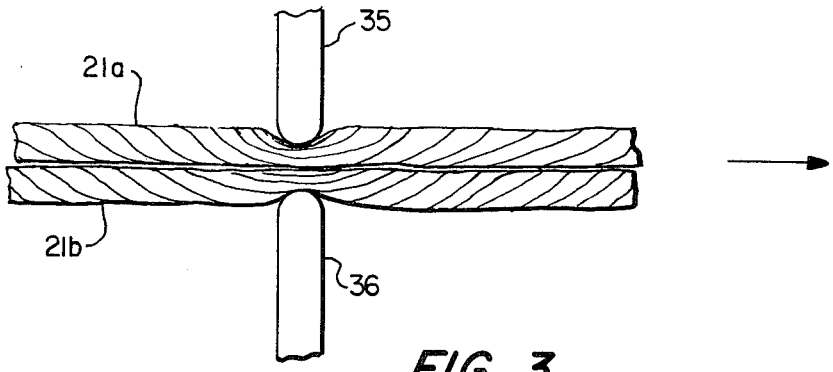
FIGS. 3, 4 and 5 are schematic diagrams illustrating the operation of the apparatus and the method of the invention.
Figure 4:
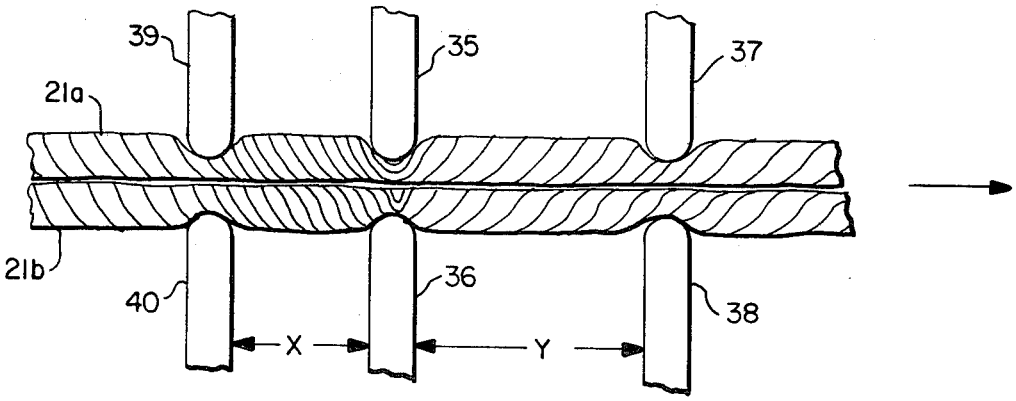
Figure 5:
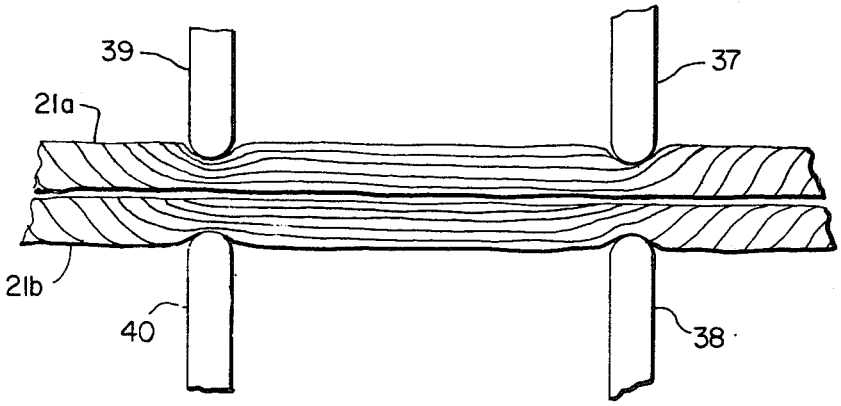
Figure 6:
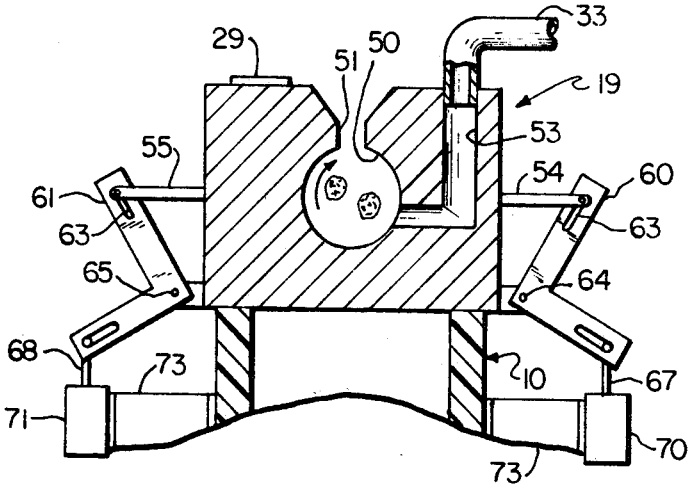
FIG. 6 is an enlarged partial view, in partial section, along line 6—6 of FIG. 7.
Figure 7:
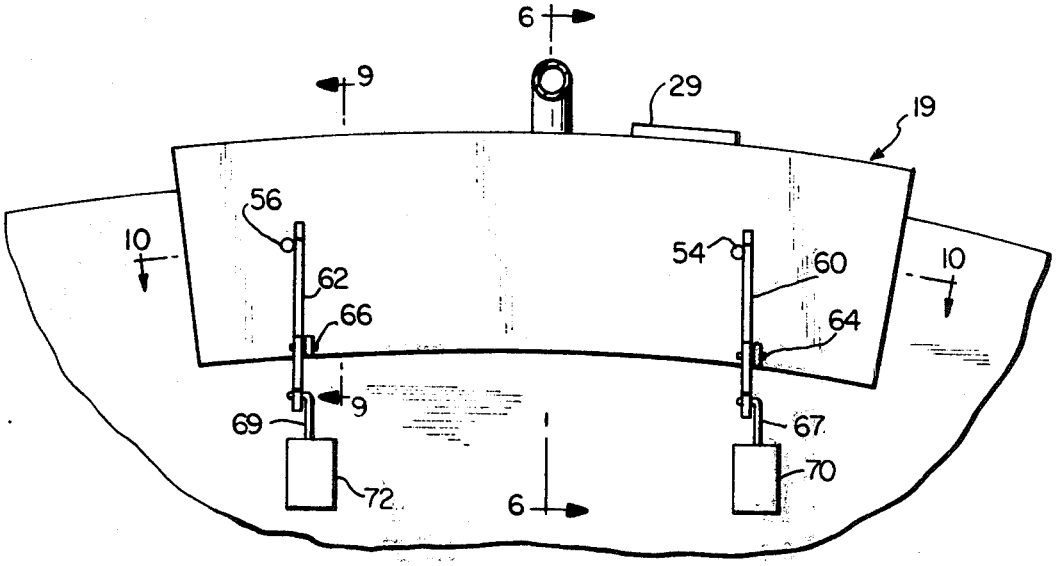
FIG. 7 is an enlarged side elevation of a portion of the apparatus of FIGS. 1 and 2.
Figure 8:
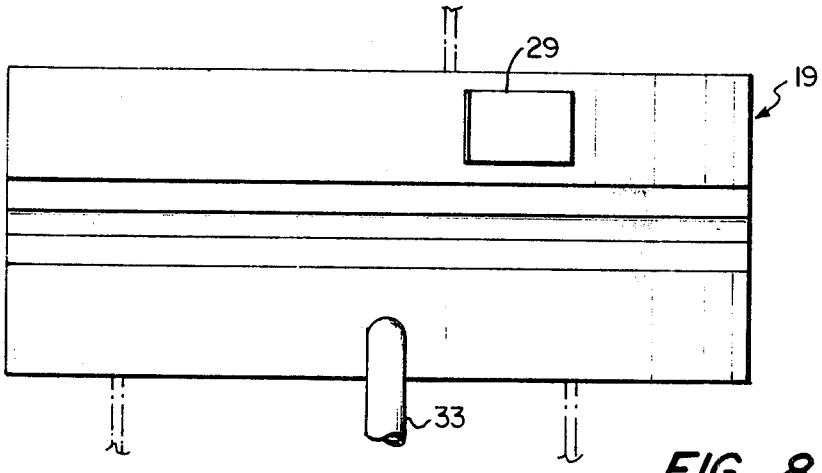
FIG. 8 is a top plan view of the structure of FIG. 7.

Before describing the joining device itself in greater detail, reference is made to FIGS. 3, 4 and 5 wherein the principle of operation of the system and the method of the invention is illustrated. As seen in FIG. 3, yarn strands 21*a* and 21*b* are delivered in side-by-side relationship to a joining region, the yarns having false twist imparted thereto by jets 20. In the joining region the yarn strands are engaged by clamping means illustrated in FIGS. 3 and 4 by clamping members 35 and 36. The direction of twist is then reversed so that the jets impart opposite twist from that imparted before the clamping devices were actuated. The point of clamping then becomes a twist trap and defines a node or point of twist reversal in the yarn. It will be observed that, at this stage, there is no region in which the yarn is not twisted except for the very small region between clamping members 35 and 36. In the next step, the yarns are clamped together at two additional points spaced upstream and downstream of the first clamping point by a pair of clamping members 37 and 38 downstream of the first clamping members and by members 39 and 40 upstream. It will be observed that members 39 and 40 are spaced upstream from the first clamping point by a distance X which is smaller than the distance Y between the first clamping point and downstream members 37 and 38. The reason for this difference in spacing is that the degree of twist upstream of the first clamping point is greater than that downstream since the last turns produced by the twist jet are produced against the built-up turns on the entry side, whereas the first turns produced after twist reversal run through the jet aided by the jet torque. These distances are selected so that the number of turns in the distance X is equal to the number of turns in the distance Y.

In the next step, members 35 and 36 are withdrawn from the first clamping point while the other clamping members remain engaged with the yarns. This permits the yarns to relax and the turns to cancel out as the yarns untwist, producing a region including distances X and Y which has zero twist. The filaments in this portion of the yarn are thus untwisted and relatively loose, and the filaments thereof can more easily be intertwined. This portion is then subjected to a vortex of fluid, causing the fibers to be entangled, thereby locking this point which becomes a locked node of twist reversal. The strands may be subjected to pressure and ultrasonic vibrations between members 37 and 39 to elevate the fiber temperature and bond the strands together.

After this operation has been completed, the yarns thus joined are removed from the yarn wheel as shown at 41 in FIG. 1 and the yarns can be permitted to self-twist with each other, forming a self-twisted yarn.

A specific apparatus for performing this function on the yarn wheel is shown in greater detail in FIGS. 6–10 wherein the joining device is seen to include a block of material having an axial bore 50 extending longitudinally therethrough and a slot 51 extending from the outer surface of the block to bore 50. Conduit 33 is connected to the upper end of a passage 53 which extends downwardly and inwardly to the lower portion of bore 50 so that when fluid under pressure is introduced through the conduit, it causes a generally helical flow of air therein and whips the fibers of the strands around, causing them to join.

Clamping members include rods 54, 55 and 56 which extend through the body into the bore, the rods having shoes 57, 58 and 59 thereon so that when the rods are moved inwardly, the shoes engage the yarn and clamp the yarn at spaced points against the inner surface of bore 50. The outer ends of the rods are coupled by pins to L-shaped crank arms 60, 61 and 62, respectively, each of these arms having an elongated slot to permit sliding movement of the coupling pins. Each of the crank arms is pivotally coupled at its vertex to a fixed point on the outer portion of the body, these pivot points being identified as 64, 65 and 66, respectively. The other end of each crank arm is coupled to a link member 67, 68 and 69 which constitute the operating shafts of linear solenoids 70, 71 and 72 which are mounted on the exterior surfaces of wheel 10 by brackets 73. The solenoids are connected so that, when energized, they cause their respective output lengths 67–69 to move upwardly, thereby rotating the crank arms about pivot points 64, 65 and 66, causing the rods coupled to the upper ends thereof to move inwardly to clamp the yarns. As will be recognized from the discussion of FIGS. 3–5, solenoids 70 and 72 are energized together while solenoid 71 is energized independently and actuates rod 55 so that shoe 58 becomes the first clamping member.

As will be seen in FIG. 10, the sequence of operation is arranged such that rod 55 forces shoe 58 toward one side of bore 50, clamping the yarn at the first point. Then, the direction of twist in jets 20 is reversed. Shortly thereafter, rods 54 and 56 are actuated to cause shoes 57 and 59 to press against spaced points upstream and downstream of shoe 58, clamping the yarns against the opposite side of the bore, and holding the yarn in the zig-zag fashion illustrated in FIG. 10. Then, rod 55 is withdrawn, permitting shoe 58 to release the yarns, whereupon fluid under pressure is supplied through conduit 33 to cause the filaments of the yarns between shoes 57 and 59 to rotate and become entangled, locking the yarns together in the clamped region. Creating the zig-zag pattern with the three shoes before entanglement has the advantage that, when shoe 58 is extracted, the tension in the yarns between shoes 57 and 59 is greatly reduced, enhancing the interlocking action.

As will also be observed in FIG. 10, recesses in the side walls of bore 50 can be provided so that the shoes can be withdrawn substantially completely from the bore to prevent inadvertent interference of the shoes with passage of the yarn into and out of the slot when the yarn is removed from wheel 10 or inserted into the slot.

It will be recognized that the rotation of wheel 10 is selected so that its peripheral movement is substantially the same as the longitudinal movement of the yarn, thereby preventing relative movement between the yarn and the wheel surface. Thus, the longitudinal spacing between locked nodes in the resulting yarn is a function of wheel diameter, a node being produced for each rotation of the locking mechanism. If desired, more than one locking means 19 can be provided on the wheel, thereby permitting the production of yarn with more closely spaced nodes.

While a particularly advantageous embodiment has been chosen to illustrate the invention, it will be understood by those skilled in the art that various changes and modifications can be made therein without departing from the scope of the invention as defined in the appended claims.

What is claimed is:

1. A method of joining yarn strands at longitudinally spaced points in a continuous yarn production system of the type having means for forming and longitudinally moving a plurality of yarn strands, and reversible twisting means for imparting false twist to each of the longitudinally moving strands in alternating length segments of S and Z twist, the method including the steps of engaging the yarn strands at a first point downstream of the twisting means to establish a twist trap point;

reversing the twist direction of said twisting means;

engaging the yarn strands at second and third points spaced upstream and downstream, respectively, of said first point and downstream of said twisting means, the spacings between the first point and the second and third points being chosen to include substantially equal numbers of turns of opposite twist between said first point and said second and third points respectively;

releasing the strands at said first point to permit the strands between said second and third points to untwist;

joining the strands together between said second and third points to form joined nodes of twist reversal; and releasing the strands at the second and third points and permitting the strands to self-twist.

2. A method according to claim 1 wherein the step of joining includes directing a jet of fluid under pressure at the strands between the second and third points to entangle the fibers of the strands with each other.

3. A method according to claim 2 and further comprising, before the step of joining, the step of reducing the level of tension in the strands between the second and third points.

4. A method according to claim 1 wherein the step of joining includes subjecting the strands to pressure and ultrasonic vibrations between the second and third points to elevate the temperature of the fibers therein, whereby the strands are bonded together.

5. An apparatus for repetitively joining yarn strands at longitudinally spaced points in a continuous yarn production system of the type having means for forming and longitudinally moving a plurality of yarn strands and reversible twisting means for imparting false twist to each of the longitudinally moving strands in alternating length segments of S and Z twist, comprising the combination of first means downstream of the twisting means for gripping the yarn strands at a first point at which the twist in said strands reverses;

second means for gripping the strands at second and third points on opposite sides of said first point relative to the direction of motion of the strands, said first and second means being longitudinally movable with the strands;

control means for actuating said first and second gripping means in sequence and for causing said first means to be released after actuation of said second means; and fluid jet means for directing a jet of fluid under pressure at said strands between said second and third points to entangle the fibers of said strands and thereby join the strands together.

6. An apparatus according to claim 5 further comprising a rotating yarn guide wheel having flange means for defining a plurality of peripheral yarn strand guide paths, said first means, said second means and said fluid jet means being rotatably carried on said wheel at a point adjacent said paths.

7. An apparatus according to claim 6 wherein said first means for gripping includes a stop surface and a first member movable in one direction transversely relative to said direction of motion of the strands to press said strands against said stop surface, and said second means for gripping includes a second stop surface and second and third members movable in a direction opposite to said one direction to press said strands against said second stop surface whereby, when said first and second means are sequentially actuated and said first means is subsequently released, the tension in the strands between said second and third members is reduced.

* * * * *